US011236462B2

(12) United States Patent
Zheng et al.

(10) Patent No.: US 11,236,462 B2
(45) Date of Patent: Feb. 1, 2022

(54) METHOD AND APPARATUS FOR DETERMINING DRYING OF CLOTHES

(71) Applicants: GREE ELECTRIC APPLIANCES (WUHAN) CO., LTD, Hubei (CN); GREE ELECTRIC APPLIANCES, INC. OF ZHUHAI, Guangdong (CN)

(72) Inventors: Mingxing Zheng, Guangdong (CN); Hongyong Yang, Guangdong (CN); Jian Liu, Guangdong (CN)

(73) Assignee: Gree Electric Appliances (Wuhan) Co., Ltd, Guangdong (CN)

( * ) Notice: Subject to any disclaimer, the term of this patent is extended or adjusted under 35 U.S.C. 154(b) by 66 days.

(21) Appl. No.: 16/641,511

(22) PCT Filed: Jun. 14, 2018

(86) PCT No.: PCT/CN2018/091361
§ 371 (c)(1),
(2) Date: Feb. 24, 2020

(87) PCT Pub. No.: WO2019/041970
PCT Pub. Date: Mar. 7, 2019

(65) Prior Publication Data

US 2020/0354881 A1 Nov. 12, 2020

(30) Foreign Application Priority Data

Aug. 29, 2017 (CN) ..... 201710757023.0

(51) Int. Cl.
*F26B 3/00* (2006.01)
*D06F 58/38* (2020.01)
(Continued)

(52) U.S. Cl.
CPC ..... *D06F 58/38* (2020.02); *D06F 34/26* (2020.02); *D06F 2103/08* (2020.02); *D06F 2103/32* (2020.02); *D06F 2105/28* (2020.02)

(58) Field of Classification Search
CPC ..... D06F 58/38; D06F 34/26; D06F 2103/08; D06F 2103/32; D06F 2105/28
(Continued)

(56) References Cited

U.S. PATENT DOCUMENTS 7,941,937 B2 * 5/2011 Do ..... D06F 58/30 34/381
2003/0230005 A1 12/2003 Lapierre
(Continued)

FOREIGN PATENT DOCUMENTS

CN 102505439 A 6/2012
CN 102517861 A 6/2012
(Continued)

OTHER PUBLICATIONS

Office Action dated Jan. 23, 2019 for Chinese Application No. 201710757023.0 (7 pages).
(Continued)

*Primary Examiner* — John P McCormack
(74) *Attorney, Agent, or Firm* — Brandon V. Zuniga; James R. Gourley; Carstens & Cahoon, LLP

(57) ABSTRACT

Disclosed are a method and an apparatus for determining drying of clothes. The method for determining drying of clothes includes: acquiring an intake air temperature at an air inlet of a drum; calculating a change rate of the intake air temperature at the air inlet of the drum; determining that drying of the clothes is completed when a relationship between the change rate of the intake air temperature and a preset temperature change rate $k_s$ satisfies a determination condition. According to the clothes drying determination
(Continued)

method of the present disclosure, the determination factors affecting the drying of clothes are reduced, and the accuracy of determination of drying of clothes is improved and the cost of drying clothes is reduced.

6 Claims, 4 Drawing Sheets

(51) Int. Cl.
*D06F 103/08* (2020.01)
*D06F 105/28* (2020.01)
*D06F 103/32* (2020.01)
*D06F 34/26* (2020.01)

(58) Field of Classification Search
USPC ..... 34/491, 493, 497
See application file for complete search history.

(56) References Cited

U.S. PATENT DOCUMENTS

| | | | | |
|---|---|---|---|---|
| 2012/0066928 | A1* | 3/2012 | Son | F26B 21/004 34/427 |
| 2013/0255101 | A1 | 10/2013 | Lee et al. | |

FOREIGN PATENT DOCUMENTS

| | | | |
|---|---|---|---|
| CN | 107663761 | A | 2/2018 |
| EP | 2735640 | A2 | 5/2014 |
| GB | 1516501 | A | 7/1978 |
| JP | S5914893 | A | 1/1984 |
| JP | S6024900 | A | 2/1985 |
| JP | S60119999 | A | 6/1985 |
| JP | H0412800 | A | 1/1992 |
| JP | H04256798 | A | 9/1992 |
| JP | H0510669 | A | 1/1993 |

OTHER PUBLICATIONS

Extended Search Report dated May 12, 2020 for European Application No. EP 18849960.2 (8 pages).
English translation of CN107663761A published on Feb. 6, 2018 (7 pages).
English translation of JPS60119999A published on Jun. 27, 1985 (2 pages).
English translation of JPS6024900A published on Feb. 7, 1985 (4 pages).

* cited by examiner

METHOD AND APPARATUS FOR DETERMINING DRYING OF CLOTHES

CROSS REFERENCE TO RELATED APPLICATIONS

This application is a U.S. National Stage of International Application No. PCT/CN2018/091361, filed on Jun. 14, 2018 and published as WO 2019/041970 on Mar. 7, 2019, which claims priority to Chinese Patent Application No. 201710757023.0, entitled "Method and Apparatus for Determining Drying of Clothes", filed with the Chinese Patent Office on Aug. 29, 2017. Each application, publication, and patent listed in this paragraph are hereby incorporated by reference in their entireties.

TECHNICAL FIELD

The present disclosure relates to the field of drying technology of clothes, and particularly to a method and an apparatus for determining drying of clothes.

BACKGROUND

Most methods for determining drying of clothes used by the current washing and drying machines all use temperature values from a plurality of temperature sensors and a complex algorithm to implement the determination of the drying of clothes. In the prior art, the degree of drying of the clothes is determined through temperature values from a plurality of temperature sensors and a calculation with the complex algorithm, or the degree of drying of the clothes is conveniently determined. However, the above solution uses too many sensors, resulting in too many factors affecting the determination of the drying of the clothes. Once something goes wrong, it is easy to lead to a wrong determination; in addition, too many temperature sensors are also easy to increase the cost of clothes drying.

SUMMARY

For this, the technical problems to be solved by the present disclosure are to provide a method and an apparatus for determining drying of clothes, which can reduce the factors affecting the determination of drying of clothes, improve the accuracy of determination of drying of clothes and reduce the cost of drying clothes.

In order to address the above problems, the present disclosure provides a method for determining drying of clothes, including:

acquiring an intake air temperature at an air inlet of a drum;

calculating a change rate of the intake air temperature at the air inlet of the drum;

determining that drying of the clothes is completed when a relationship between the change rate of the intake air temperature and a preset temperature change rate $k_s$ satisfies a determination condition.

Preferably, the method further includes:

after acquiring the intake air temperature at the air inlet of the drum and before calculating the change rate the intake air temperature at the air inlet of the drum;

stopping heating the intake air when the intake air temperature at the air inlet of the drum satisfies $T_{in} \geq T_h$;

start heating the intake air when the intake air temperature at the air inlet of the drum satisfies $T_{in} \leq T_1$;

This a temperature at which heating of the intake air is stopped, and $T_1$ is a temperature at which the heating of the intake air is started, when the intake air temperature is greater than or equal to $T_h$, the heating of the intake air is stopped, and when the intake air temperature is less than or equal to $Th_1$, the heating of the intake air is started.

Preferably, the calculating the change rate of the intake air temperature at the air inlet of the drum includes:

calculating a change rate k of the intake air temperature from $T_1$ to Th, where $k=(T_h-T_1)/t$, t is time taken for the intake air temperature to increase from $T_1$ to Th.

Preferably, the determining that the drying of the clothes is completed when the relationship between the change rate of the intake air temperature and the preset temperature change rate $k_s$ satisfies the determination condition includes:

taking time taken for the intake air temperature to decrease from $T_h$ to $T_1$ and then increase from $T_1$ to $T_h$ as a cycle, determining heating-up time $t_1, t_2, t_3, \ldots, t_n$ in each cycle, and calculating a heating-up change rate $k_1, k_2, k_3, \ldots, k_n$ in each cycle;

determining the heating-up change rate $k_n$ in each cycle, if $k_n \geq k_s$, determining that the clothes are dried, and ending the drying;

if $k_n < k_s$, determining that the clothes are not yet dried, and continuing the drying.

Preferably, the determining the heating-up change rate $k_n$ in each cycle, if $k_n \geq k_s$, determining that the clothes are dried and ending the drying includes:

detecting the heating-up change rates $k_n$ in m consecutive cycles; if the heating-up change rates $k_n$ in the m consecutive cycles all satisfy $k_n \geq k_s$, determining that the clothes are dried, where $m \leq 3$.

Preferably, the preset temperature change rate $k_s$ is one of: a drying temperature change rate in an ironing state, a drying temperature change rate in a wearing state, and a drying temperature change rate in an extremely dry state.

According to another aspect of the present disclosure, an apparatus for determining drying of clothes is provided, including:

a temperature detection unit configured to acquire an intake air temperature at an air inlet of a drum;

a calculation unit configured to calculate a change rate of the intake air temperature detected by the temperature detection unit;

determination unit configured to compare the change rate of the intake air temperature to a preset temperature change rate $k_s$, and determine whether drying of clothes is completed according to a comparison result.

Preferably, the apparatus for determining drying of clothes further includes a heating control unit configured to control a heater to stop heating intake air when the intake air temperature at an air inlet of a drum satisfies $T_{in} \geq T_h$, and control the heater to start heating the intake air when the intake air temperature at the air inlet of the drum satisfies $T_{in} \leq T_1$.

Preferably, the apparatus for determining drying of clothes further comprises a memory, the memory stores a preset temperature change rate $k_s$, and the determination unit acquires the preset temperature change rate $k_s$ from the memory.

The method for determining drying of clothes provided by the present disclosure includes: acquiring an intake air temperature at an air inlet of a drum; calculating a change rate of the intake air temperature at the air inlet of the drum; determining that drying of the clothes is completed when a relationship between the change rate of the intake air temperature and a preset temperature change rate $k_s$ satisfies a determination condition. As for the method for determining drying of clothes in the present disclosure, only one determination factor, i.e., the intake air temperature at the air inlet of the drum, is needed to use to determine whether the clothes are dried according to the relationship between the change rate of the intake air temperature and the preset temperature change rate $k_s$. In such a way, the determination factors affecting the drying of clothes are reduced, the determination conditions of drying of clothes are simplified, and the accuracy of determination of drying of clothes is improved. In addition, because the present method only uses one factor, i.e., the intake air temperature at the air inlet of the drum, the acquiring of temperature can be completed with only one temperature sensor, which can reduce the number of temperature sensors and reduce the cost of drying clothes.

DETAILED DESCRIPTION OF DISCLOSED EMBODIMENTS

Figure 1:
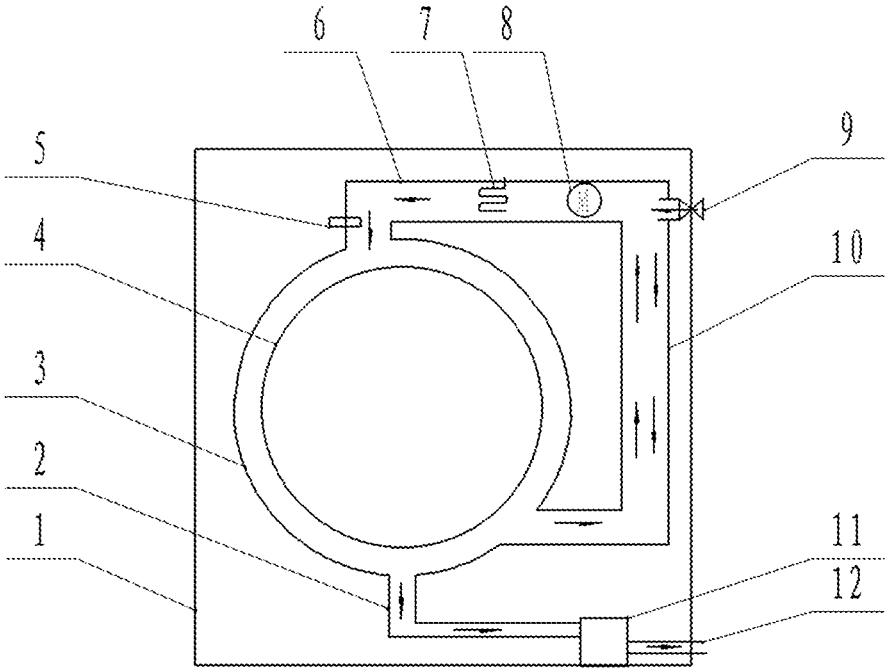
FIG. 1 is a schematic structure diagram of a clothes drying device.
Figure 2:
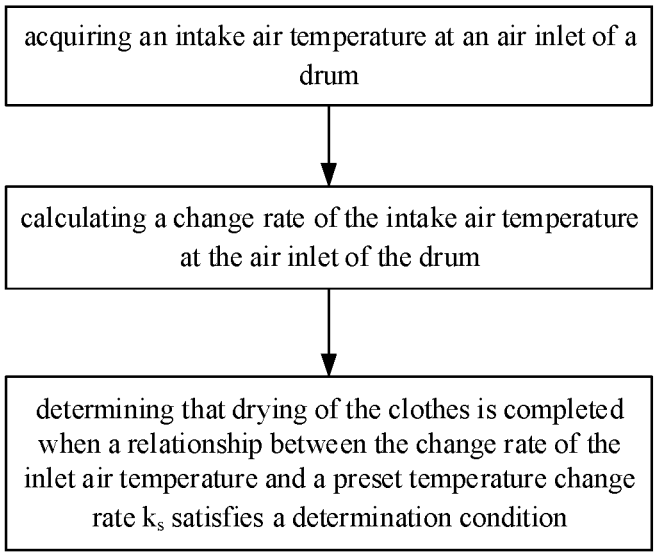
FIG. 2 is a flow chart of a method for determining drying of clothes according to an embodiment of the present disclosure.

Referring to FIG. 1, the clothes drying device applied in the present disclosure includes a case 1, a drain hose 2, an outer cylinder 3, an inner cylinder 4, an intake air temperature sensor 5, an upper air duct 6, a heating pipe 7, a fan 8, a water inlet valve 9, a rear air duct 10, a drain pump 11 and a drain pipe 12. Each component is arranged in the case 1.

The inner cylinder 4 and the outer cylinder 3 are collectively referred to as a drum. The inner cylinder 4 is sleeved inside the outer cylinder 3. The air inlet of the outer cylinder 3 is connected to the air outlet of the upper air duct 6. The air inlet of the outer cylinder 3 (an air inlet of the drum) is provided with the intake air temperature sensor 5, a heating pipe 7 and a fan 8 are provided in the upper air duct 6, and a water inlet valve 9 is provided at a position where the upper air duct 6 intersects the rear air duct 10. A drain hose 2 is provided at a bottom portion of the outer cylinder 3. The drain hose 2 is connected to a drain pump 11, and a drain pipe 12 is connected to a drain outlet of the drain pump 11.

Figure 3:
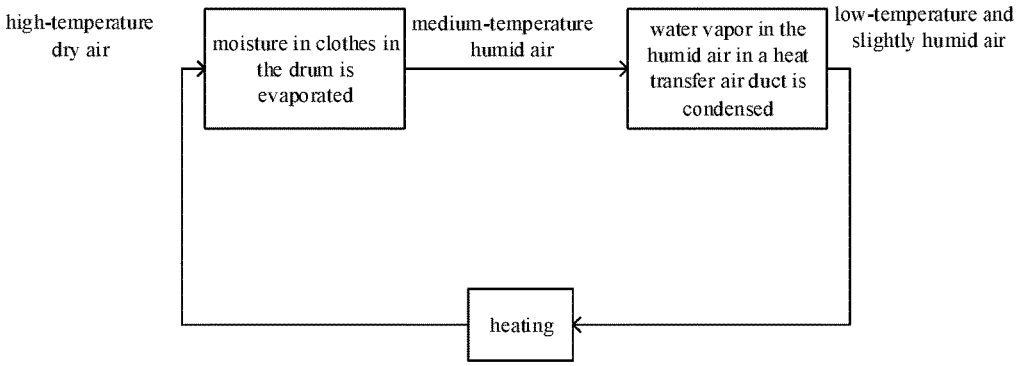
FIG. 3 is a principle diagram illustrating drying and dehumidifying of a clothes drying device.
Figure 4:
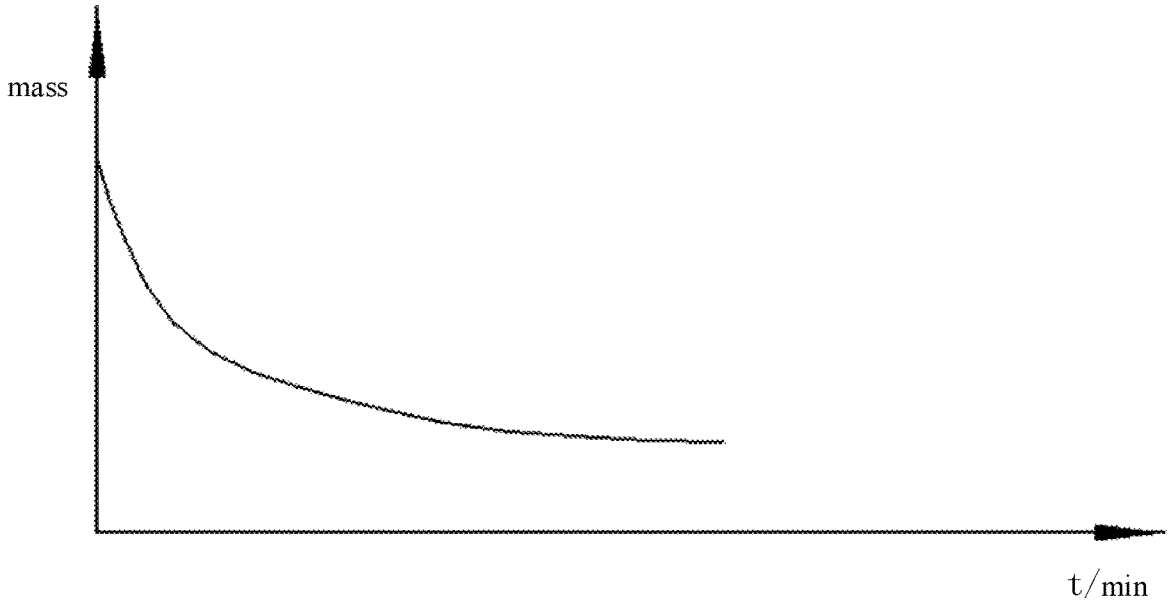
FIG. 4 is a diagram showing a change in mass of clothes during a process of drying clothes.
Figure 5:
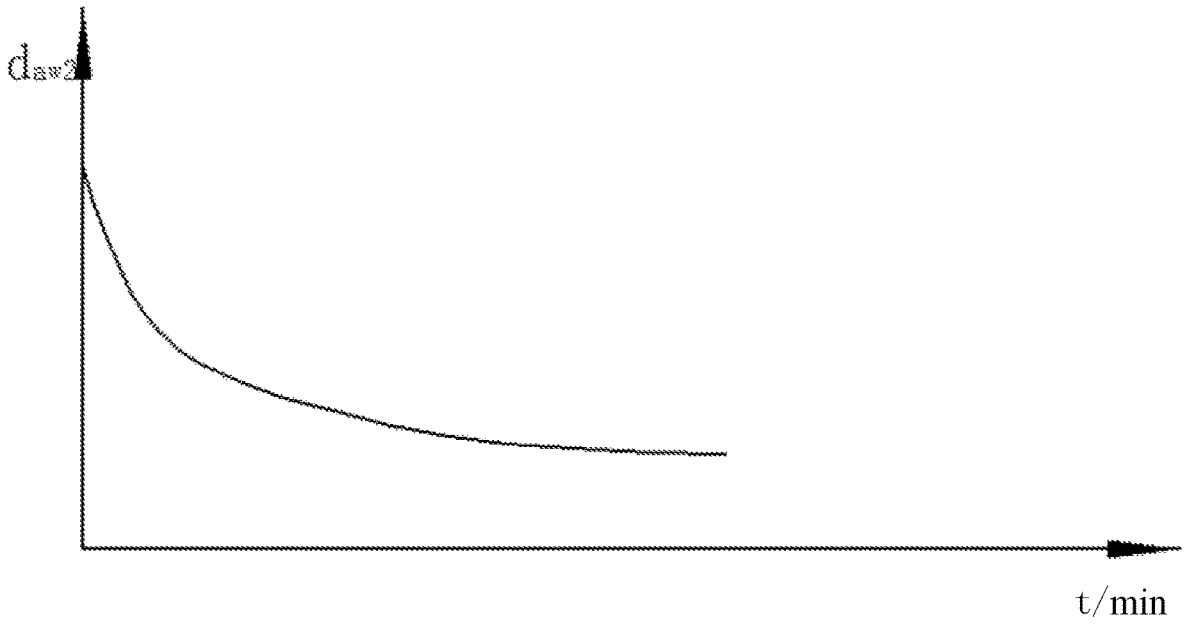
FIG. 5 is a diagram showing a change in a moisture content of humid air after passing through a drum during a process of drying clothes.
Figure 6:
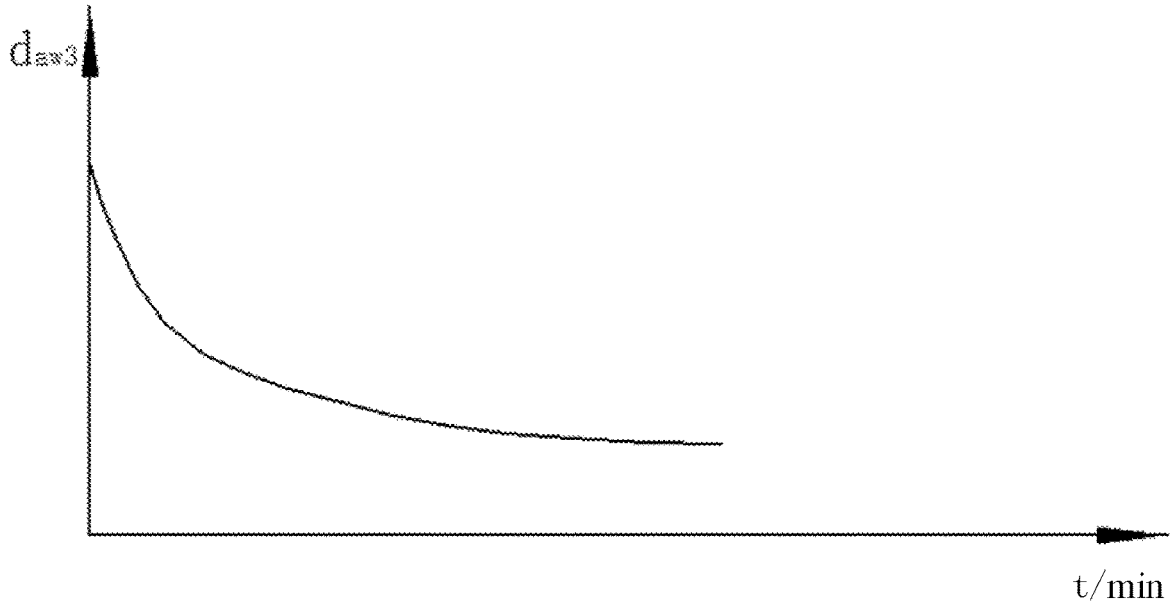
FIG. 6 is a diagram showing a change in a moisture content of humid air after heat exchange and condensation during a process of drying clothes.

Referring to FIG. 1 and FIG. 3, after the clothes drying device is powered on, the fan 8 rotates and blows the low-temperature and slightly humid air to the heating pipe 7 to heat the air, and then the high-temperature dry air enters the outer cylinder 3 through the upper air duct 6. In this process, the intake air temperature sensor 5 detects the temperature in real time and controls the start and stop of the heating pipe 7. The high-temperature dry air passes through the wet clothes in the inner cylinder 4, to evaporate the moisture in the wet clothes and take the moisture away. The high-temperature dry air becomes medium-temperature humid air, and the medium-temperature humid air enters the rear air duct 10. At this time, the water inlet valve 9 is opened; the condensed water enters the rear air duct 10, where the medium-temperature humid air exchanges the heat with the condensed water, the water vapor in the medium-temperature humid air is condensed into water which flows with the condensed water to the bottom portion of the outer cylinder 3 and passes through the drain hose 2 to the drain pump 11, and then the water is drained through the drain pipe 12. By circulating in the above mode, the moisture in the clothes can be gradually removed.

As shown in FIGS. 4 to 7, as the drying progresses, the mass m of the clothes is gradually decreased to a stable level; the water vapor taken away by the dry air becomes less and less; the moisture content daw2 of the humid air when the drum blows and the moisture content daw3 of the slightly humid air after the heat exchange and condensation are also gradually decreased until stabilization. Because the moisture content daw1 of the heated high-temperature dry air is smaller, it can be ignored here.

By the following formula:

$$C_{paw}=1.01+1.84*d_{aw}$$

$$Q=c_{paw}*M*(T_h-T_1)$$

$$W=p*t_n$$

It can be $k_n$ own that the specific heat capacity at constant pressure $c_{paw}$ of the humid air is positively related to the moisture content daw, thus the quantity of heat Q required to heat the humid air of mass M from $T_1$ to $T_h$ is positively related to the specific heat capacity at constant pressure $c_{paw}$ of the humid air. The power p of the heating pipe is constant, thus the heating-up time $t_n$ (n=1, 2, 3 . . . ) in each cycle becomes shorter and shorter, and the corresponding heating-up change rate $k_n=(T_h-T_1)/t_n$ becomes greater and greater. $T_h$ is a temperature at which heating of the intake air is stopped, and $T_1$ is a temperature at which the heating of the intake air is started. When the intake air temperature is greater than or equal to $T_h$, the heating pipe stops heating; and when the intake air temperature is less than or equal to $T_1$, the heating pipe starts heating.

Figure 7:
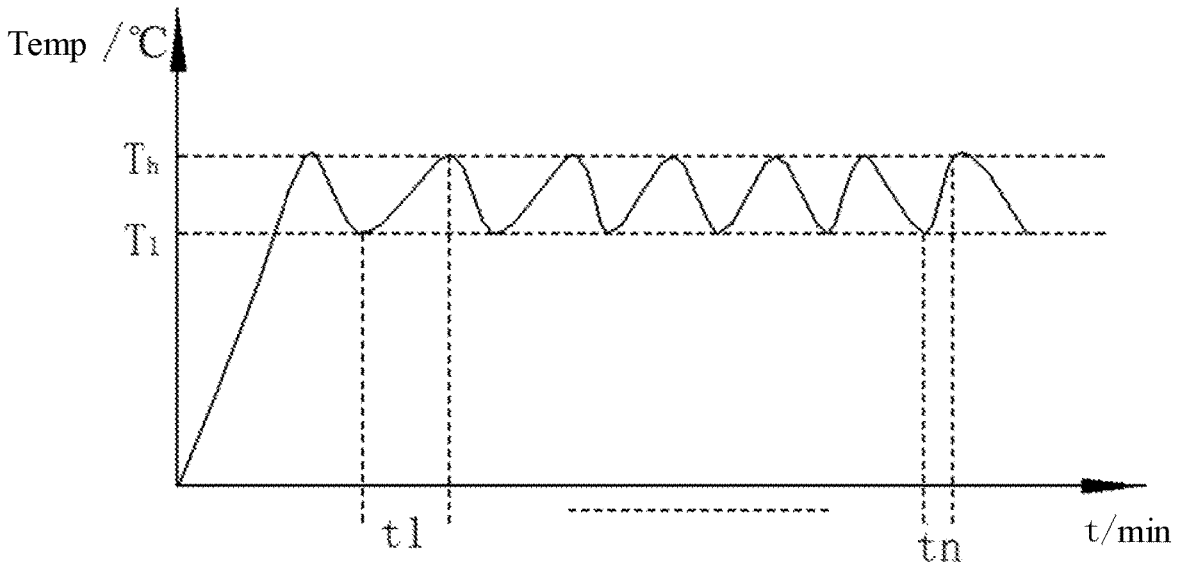
FIG. 7 is a diagram showing a heating control during a process of drying clothes.

With reference to FIG. 7, from the real-time change trend curve of the intake air temperature during the drying process controlled by the intake air temperature, it can be $k_n$ own that, as the drying progresses, $t_n$ (n=1, 2, 3, . . . ) is getting smaller and smaller until the clothes are dried. Thus, whether the clothes are dried can be determined according to a heating-up rate of the intake air temperature, that is, a change in the change rate of the intake air temperature. The idea of the present disclosure is based on the above analysis.

Referring to FIG. 2 to FIG. 7, according to an embodiment of the present disclosure, a method for determining drying of clothes includes: an intake air temperature at an air inlet of a drum is acquired; a change rate of the intake air temperature at the air inlet of the drum is calculated; when the relationship between the change rate of the intake air temperature and a preset temperature change rate $k_s$ meets a determination condition, it is determined that the clothes are dried.

As for the method for determining drying of clothes in the present disclosure, only one determination factor, i.e., the intake air temperature at the air inlet of the drum, is needed to use to determine whether the clothes are dried according to the relationship between the change rate of the intake air temperature and the preset temperature change rate $k_s$. In such a way, the determination factors affecting the drying of clothes are reduced, the determination conditions of drying of clothes are simplified, and the accuracy of determination of drying of clothes is improved. In addition, because the measurement factor of the present method only includes one factor, i.e., the intake air temperature at the air inlet of the drum, the acquiring of temperature can be completed with only one temperature sensor, which can reduce the number of temperature sensors and reduce the cost of drying clothes, and meanwhile can also avoid the problem of lower accuracy of determination caused by multiple factors affecting each other.

After the step of acquiring the air inlet temperature at the air inlet of the drum, and before the step of calculating the change rate of the intake air temperature at the air inlet of the drum, the method further includes: when the intake air temperature at the air inlet of the drum satisfies a condition $T_{in} \geq T_h$, the heating of the intake air is stopped; and when the intake air temperature at the air inlet of the drum satisfies a condition $T_{in} \leq T_1$, the heating of the intake air is started. Because the heating pipe can heat the air and the heating temperature is higher, if the intake air is heated to reach a higher temperature beyond a temperature range the clothes can withstand, the clothes may be damaged. As a result, the intake air temperature needs to be controlled. When the intake air temperature reaches or exceeds $T_h$, the heating of the intake air is stopped, thereby reducing the intake air temperature and protecting the clothes. Accordingly, if the intake air temperature is less than or equal to $T_1$, the drying temperature is too low to fully gasify the moisture in the clothes and take the moisture in the clothes away. Therefore, it is needed to heat the intake air when the intake air temperature is less than or equal to $T_1$, thereby increasing the intake air temperature and improving the drying efficiency of the clothes.

Preferably, the step of calculating the change rate of the intake air temperature at the air inlet of the drum includes: a change rate k of the intake air temperature when the intake air temperature is changed from $T_1$ to $T_h$ is calculated, where $k=(T_h-T_1)/t$, and t is a time taken for the intake air temperature to increase from $T_1$ to $T_h$.

Preferably, when the relationship between the change rate of the intake air temperature and the preset temperature change rate ks satisfies the determination condition, the step of determining the completion of the drying of clothes includes: a time taken for the intake air temperature to decrease from $T_h$ to $T_1$ and then increase from $T_1$ to $T_h$ is taken as a cycle; heating-up time $t_n$ (n=1, 2, 3 . . . ) in each cycle is determined; the heating-up change rate $k_n$ (n=1, 2, 3 . . . ) in each cycle is calculated; the heating-up change rate $k_n$ in each cycle is determined, if $k_n \geq ks$, it is determined that the clothes are dried, then the drying ends; if $k_n < k_s$, it is determined that the clothes are not yet dried, and the drying is continued. The change rate of the intake air temperature includes a heating-up change rate $k_n$ and a cooling-down change rate. The factor directly affected by the heating pipe is the heating-up change rate of the intake air temperature, thus the heating-up change rate of the intake air temperature can be selected as a determination condition for determining whether the clothes are dried. Because the less the moisture content in the clothes, the greater the heating-up change rate $k_n$, when $k_n$ reaches or is greater than the preset temperature change rate $k_s$, it means that the moisture in the clothes has reduced to a certain degree which can meet the drying requirement. Therefore, the completion of drying clothes can be determined simply by detecting the change of $k_n$, i.e., when the $k_n$ is greater than or equal to ks, the drying ends.

Preferably, the step of determining the heating-up change rate $k_n$ in each cycle, if $k_n \geq k_s$, determining that the clothes are dried and ending the drying includes: heating-up change rates $k_n$ in m consecutive cycles are detected; if the heating-up change rates $k_n$ in the consecutive cycles all satisfy $k_n \geq k_s$, it is determined that the clothes are dried, where $m \geq 3$. Because in the actual drying process of the clothes, there are still some influencing factors making $k_n$ greater than or equal to $k_s$, but at this point there is still the possibility that the clothes are not yet dried. Accordingly, in order to further improve the accuracy of determination of drying of the clothes, the heating-up change rates $k_n$ in m consecutive cycles can be detected. If the heating-up change rates $k_n$ in the m consecutive cycles all satisfy $k_n \geq k_s$, it means that the moisture in the clothes has indeed satisfied the drying requirement, and it can be determined that the clothes have been dried.

The preset temperature change rate $k_s$ is one of: a drying temperature change rate in an ironing state, a drying temperature change rate in a wearing state, and a drying temperature change rate in an extremely dry state. By changing the preset temperature change rate $k_s$, the clothes can be dried to the corresponding drying degree according to different requirements, and consequently, various drying requirements of clothes can be better met and the applicability of drying of clothes is improved.

A method for determining drying of clothes based on the intake air temperature change rate used in the present disclosure implements an accurate drying determination of clothes, compared to the conventional drying determination method, it saves cost and energy, and implements protection of the clothes.

Figure 8:
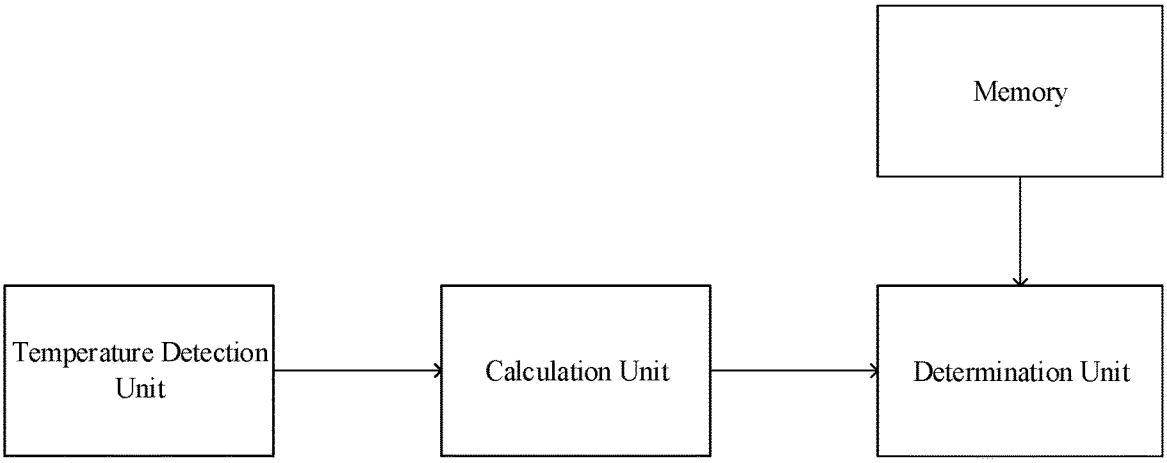
FIG. 8 is a schematic diagram showing a structure of an apparatus for determining drying of clothes according to an embodiment of the preset disclosure.

Referring to FIG. 8, according to an embodiment of the present disclosure, a apparatus for determining drying of clothes includes: a temperature detection unit configured to acquire an intake air temperature at an air inlet of a drum; a calculation unit configured to calculate a change rate of the intake air temperature according to the intake air temperature detected by the temperature detection unit; a determination unit configured to compare the change rate of the intake air temperature to a preset temperature change rate ks, and determine whether the clothes are dried according to a comparison result.

Preferably, the apparatus for determining drying of clothes further includes a heating control unit, which is configured to: control the heater to stop heating the intake air when the intake air temperature at the air inlet of the drum satisfies $T_{in} \geq T_h$; and control the heater to starting heating the intake air when the intake air temperature at the air inlet of the drum satisfies $T_{in} \leq T_1$.

Preferably, the apparatus for determining drying of clothes further includes a memory. The preset temperature change rate $k_s$ is stored in the memory, and the determination unit acquires the preset temperature change rate $k_s$ from the memory. The preset temperature change rate $k_s$ can be obtained through experiments.

Those skilled in the art can easily understand that, under the premise of no conflict, the above-mentioned advantageous modes can be freely combined and superimposed.

The above embodiments are merely preferred embodiments of the present disclosure, and are not intended to limit the present disclosure. Any modification, equivalent replacement, and improvement made within the spirit and principle of the present disclosure shall be included in the protection scope of the present disclosure. The above embodiments are merely the preferred implementations of the present disclosure. It should be pointed that those skilled in the art can further make several improvements and variations without departing from the technical principles of the present disclosure, and these improvements and variations should also be regarded as the scope of protection of the present disclosure.

What is claimed is:

1. A method for determining drying of clothes, comprising:

acquiring an intake air temperature at an air inlet of a drum;

calculating a change rate of the intake air temperature at the air inlet of the drum;

determining that drying of the clothes is completed when a relationship between the change rate of the intake air temperature and a preset temperature change rate $k_s$ satisfies a determination condition;

after acquiring the intake air temperature at the air inlet of the drum and before calculating the change rate of the intake air temperature at the air inlet of the drum;

stopping heating the intake air when the intake air temperature at the air inlet of the drum satisfies $T_{in} \geq T_h$;

starting the heating the intake air when the intake air temperature at the air inlet of the drum satisfies $T_{in} \leq T_1$;

wherein the calculating the change rate of the intake air temperature at the air inlet of the drum comprises:

calculating a change rate k of the intake air temperature from $T_1$ to $T_h$, wherein $k=(T_h-T_1)/t$, t is time taken for the intake air temperature to increase from $T_1$ to $T_h$;

wherein $T_h$ is a temperature at which the heating of the intake air is stopped, and $T_1$ is a temperature at which the heating of the intake air is started, and when the intake air temperature is greater than or equal to $T_h$, the heating of the intake air is stopped, and when the intake air temperature is less than or equal to $T_1$, the heating of the intake air is started;

wherein the determining that the drying of the clothes is completed when the relationship between the change rate of the intake air temperature and the preset temperature change rate $k_s$ satisfies the determination condition comprises:

taking time taken for the intake air temperature to decrease from $T_h$ to $T_1$ and then increase from $T_1$ to $T_h$ as a cycle, determining heating-up time $t_1$, $t_2$, $t_3$, . . . , $t_n$ in each cycle, and calculating a heating-up change rate $k_1$, $k_2$, $k_3$, . . . , $k_n$ in each cycle;

determining the heating-up change rate $k_n$ in each cycle, if $k_n \geq k_s$, determining that the clothes are dried, and ending the drying; and if $k_n < k_s$, determining that the clothes are not yet died, and continuing the drying.

2. The method for determining drying of clothes according to claim 1, wherein the determining the heating-up change rate $k_n$ in each cycle, if $k_n \geq k_s$, determining that the clothes are dried and ending drying comprises:

detecting the heating-up change rates $k_n$ in m consecutive cycles; if the heating-up change rates $k_n$ in the m consecutive cycles all satisfy $k_n \geq k_s$, determining that the clothes are dried, where $m \geq 3$.

3. The method for determining drying of clothes according to claim 1, wherein the preset temperature change rate $k_s$ is one of: a drying temperature change rate in an ironing state, a drying temperature change rate in a wearing state, and a drying temperature change rate in a selected dry state.

4. An apparatus for determining drying of clothes, comprising:

a processor and a memory for storing program instructions executed by the processor;

wherein the processor is configured to:

acquire an intake air temperature at an air inlet of a drum;

calculate a change rate of the intake air temperature detected by the temperature detection unit;

compare the change rate of the intake air temperature to a preset temperature change rate $k_s$, and determine whether drying of clothes is completed according to a comparison result;

after acquiring the intake air temperature at the air inlet of the drum and before calculating the change rate of the intake air temperature at the air inlet of the drum:

stop heating the intake air when the intake air temperature at the air inlet of the drum satisfies $T_{in} \geq T_h$;

start the heating the intake air when the intake air temperature at the air inlet of the drum satisfies $T_{in} \leq T_1$;

wherein the step of calculating the change rate of the intake air temperature at the air inlet of the drum comprises:

calculating a change rate k of the intake air temperature from $T_1$ to $T_h$, wherein $k=(T_h-T_1)/t$, t is time taken for the intake air temperature to increase from $T_1$ to $T_h$;

$T_h$ is a temperature at which the heating of the intake air is stopped, and $T_1$ is a temperature at which the heating of the intake air is started, and when the intake air temperature is greater than or equal to $T_h$, the heating of the intake air is stopped, and when the intake air temperature is less than or equal to $T_1$, the heating of the intake air is started;

wherein the step of determining that the drying of the clothes is completed when the relationship between the change rate of the intake air temperature and the preset temperature change rate $k_s$ satisfies the determination condition comprises:

taking time taken for the intake air temperature to decrease from $T_h$ to $T_1$ and then increase from $T_1$ to $T_h$ as a cycle, determining heating-up time $t_1$, $t_2$, $t_3$, . . . , $t_n$ in each cycle, and calculating a heating-up change rate $k_1$, $k_2$, $k_3$, . . . , $k_n$ in each cycle;

determining the heating-up change rate $k_n$ in each cycle, if $k_n \geq k_s$, determining that the clothes are dried, and ending the drying; and if $k_n < k_s$, determining that the clothes are not yet dried and continuing the drying.

5. The apparatus for determining drying of clothes according to claim 4, wherein the processor is further configured to be capable of executing the stored program instructions to: control a heater to stop heating the intake air when the intake air temperature at the air inlet of the drum satisfies $T_{in} \geq T_h$, and control the heater to start heating the intake air when the intake air temperature at the air inlet of the drum satisfies $T_{in} \leq T_1$.

6. The apparatus for determining drying of clothes according to claim 4, wherein the memory stores the preset temperature change rate $k_s$, and the determination unit acquires the preset temperature change rate $k_s$ from the memory.

* * * * *